US005267885A

United States Patent [19]

Niskern et al.

[11] Patent Number: 5,267,885

[45] Date of Patent: Dec. 7, 1993

[54] MODEL ROCKET KIT STRUCTURE

[75] Inventors: Keith W. Niskern, Colorado Springs; Michael K. Dorffler, Canon City, both of Colo.

[73] Assignee: Centuri Corporation, Penrose, Colo.

[21] Appl. No.: 747,882

[22] Filed: Aug. 20, 1991

[51] Int. Cl.[5] ..... A63H 27/00; A63H 33/20; A63H 27/26; F42B 15/01

[52] U.S. Cl. ..... 446/88; 446/52; 446/211; 244/3.24; 244/3.3

[58] Field of Search ..... 446/52, 56, 51, 49, 446/34, 85, 87, 88, 90, 93, 230, 231, 211, 212; 244/3.24, 3.25, 3.3, 158 R

[56] References Cited

U.S. PATENT DOCUMENTS

| | | | |
|---|---|---|---|
| 2,851,950 | 9/1958 | Van Aken et al. | 244/3.24 |
| 3,805,355 | 4/1974 | Gerulk | 29/281.4 |
| 3,888,178 | 6/1975 | Senoski | 102/34 B |
| 3,942,441 | 3/1976 | Senoski | 102/34 B |
| 3,943,656 | 3/1976 | Green | 446/52 |
| 4,202,132 | 5/1980 | Fischer | 446/93 X |
| 4,257,152 | 3/1981 | Paton | 29/281.4 |
| 4,295,290 | 10/1981 | Boswell | 446/45 |
| 4,355,577 | 10/1982 | Ady et al. | 102/378 |
| 4,374,493 | 2/1983 | Hoffing | 446/52 X |
| 5,004,186 | 4/1991 | Hans et al. | 244/3.25 |

OTHER PUBLICATIONS

Estes, TR-8 Model Rocket Technical Report TR8, Study Guide, pp. 1-11.

Estes, The Classic Collection, TR1, Rocket Stability, pp. 1-6.

Estes (1991) Flying Model Rocket Catalog pp, cover-64.

*Primary Examiner*—D. Neal Muir

*Attorney, Agent, or Firm*—Lahive & Cockfield

[57] ABSTRACT

Apparatus in kit form for the assembly of a model rocket having a body tube, fins, and propellant mount, wherein each fin has a root portion at a radially innermost end for mountingly extending through slots apertured in the body tube and for mounting engagement with the propellant mount. The body tube is apertured with slots for mountingly receiving the root portions of respective fins. The propellant mount telescopically mounts within the body tube and mountingly seats the fin roots. In one embodiment, a plurality of mounting brackets is arranged for assembly with one another for forming the propellant mount. The mounting brackets have radially-extending mounting recesses for engaging and positioning a fin root. The radially-extending mounting recesses of the assembled mounting brackets define respective sockets for mounting the root of respective fins, with the assembled fins and brackets forming the sockets in fixed rotational alignment and forming each socket with axially spaced ends thereof arranged for seating axial ends of the fin roots.

11 Claims, 4 Drawing Sheets

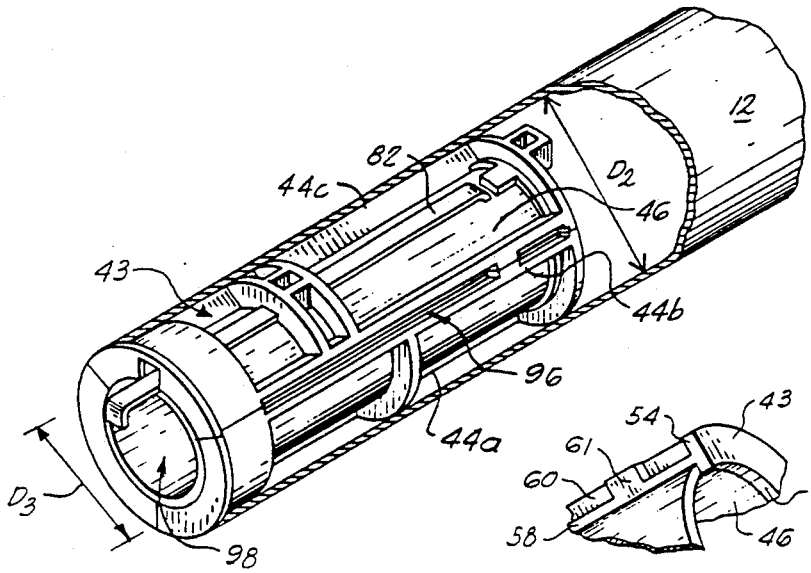
FIG. 3
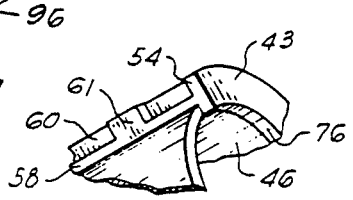
FIG. 3A
FIG. 4A
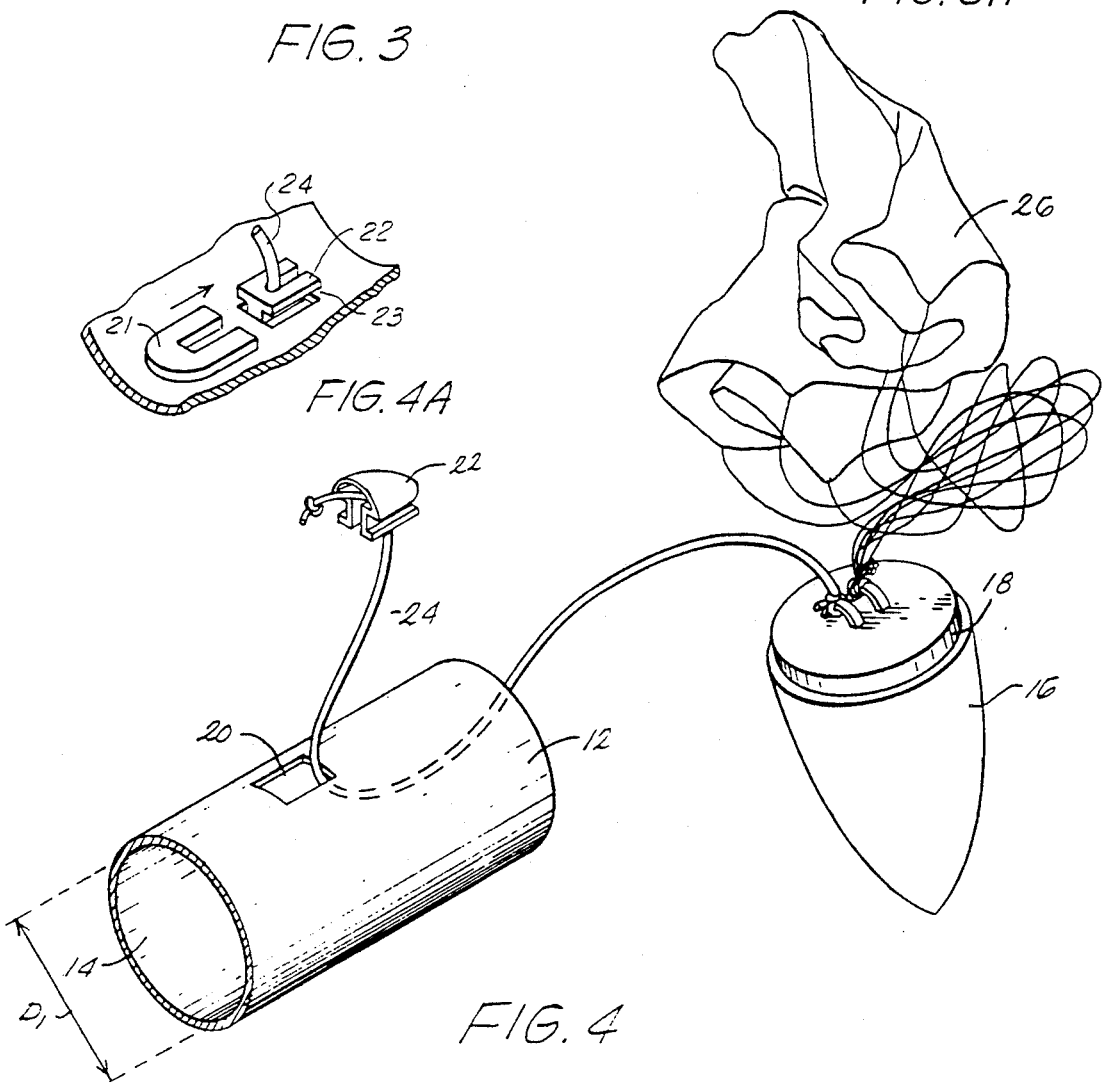
FIG. 4

MODEL ROCKET KIT STRUCTURE

This invention relates generally to model rockets. More particularly, it pertains to model rocket kits that can be assembled readily by juvenile and other novice rocketeers.

Childhood memories abound of the happy times spent assembling model boats, airplanes,, and the like, purchased in kit form. Presently, model rocket kits are popular. One specific yet illustrative prior model rocket has a nose cone which caps one end of a cylindrical body tube. The rocket fins have roots, i.e. mounting ends, that mount in slots cut into the body tube. An engine tube assembly fits within the body tube. It includes an engine tube that mountingly receives an engine, and a fin receiver for seating the root of each assembled rocket fins. A parachute is captured within the body tube and the nose cone, and is tethered by a shock cord to the engine tube assembly.

The engine tube assembly includes an engine hook mounted on the engine tube. The engine hook has a spring arm having a first end which forms a forward flange and which is held in a forward slot in the engine tube. This forward finger protrudes radially into the interior of the engine tube. A rearward end of the engine hook extends beyond the rear end of the engine tube. So mounted, the rearward end of the engine hook can be deflected to accommodate the insertion into the engine tube of a solid propellant engine having a cylindrical cartridge form. The forward end of the inserted engine is placed against the forward finger of the engine hook. The engine hook slips over the rear end of the inserted engine, to retain the engine in place.

The typical solid fuel propellant engine has three stages, namely propellant, time-delay, and ejection. When the propellant is ignited, the rocket is boosted into flight from a launch pad. After the propellant is expended, the second stage provides a time delay, and burns without powering the rocket. This allows the rocket to continue its climb, coasting under the initial power boost. After this time delay, the ejection ignites, blowing the nose cone off of the body tube. This action deploys the parachute, and allows the rocket to fall safely to the ground.

In one known rocket kit, the fin receiver includes several cooperating pairs of mounting clips formed on the outer circumference of the engine tube. Each mounting clip is generally U shaped to define a short slot that mountingly receives either a front or rear portion of the root of an inserted rocket fin. The root of each such assembled fin is cemented to a cooperating pair of the mounting clips. The paired clips are spaced apart along the axial length of the rocket body, with one clip located to engage the front of the fin and the other located to engage the back of the fin. This arrangement secures the fins and the engine tube assembly to the body tube.

In this known kit, the cooperating pairs of mounting clips are formed by cementing a pair of disk-like angular centering rings on the engine tube. Each centering ring has a plurality of mounting clips. The front and the rear portions of a given fin root are then captured between a pair of clips, one on a front centering ring and a cooperating one on a rear centering ring. Among other functions, the rings center the engine tube within the body tube of the rocket.

The centering rings must be radially and axially located on the engine tube with a degree of precision. The precise mounting is required to align and space the forward and rearward mounting clips into cooperating pairs. This positioning determines the mounting alignment of the front and rear portions of the fins after the roots are inserted through the fixed slots of the body tube and into the paired clips. Thus, the rings must be carefully aligned and spaced during assembly. Typically, the rings are aligned and permanently affixed on the engine tube by an adhesive that is allowed to set before assembling the fins and the engine tube assembly with the body tube. This assures that the carefully aligned rings are not dislodged into misalignment before the adhesive is set. It is also important that care be taken not to fill the clips with adhesive when cementing the centering rings to the engine tube, since the adhesive will be set before further assembly and the adhesive-filled clips will not be able to properly receive the fin roots. In view of the low surface area interaction of the fin roots and the cooperating pairs of clips, use of a strong adhesive, such as a cyanoacrylate or epoxy adhesive, is preferred.

In view of this state of the art, it is an object of this invention to provide a model rocket kit structure that is easy to assemble and that mounts the rocket fins with precise positioning and securely.

Another object is to provide such a structure that securely mounts a replaceable engine.

Other objects of the invention will in part be obvious and will in part appear hereinafter.

SUMMARY OF THE INVENTION

The invention provides a new model rocket structure that facilitates the unskilled and the hurried assembly of a model rocket from kit form. According to one practice of the invention, an engine tube assembly has a fin receiver formed by two or more cooperating arcuate brackets that assemble side by side around the circumference of an engine tube. This engine tube assembly fits within and has an outer diameter which is only slightly less than the inner diameter of a tubular body tube. The close diametric fit radially centers the engine tube assembly within the body tube.

The arcuate brackets of the fin receiver define fin-mounting seats of fixed dimensions and at fixed relative locations. The body tube, which telescopically fits over the brackets, has at least two fin-guiding slots formed about its circumference, and is rotatable to align these slots with the fin-mounting seats of the brackets. When the kit is assembled, the rocket fins extend radially through the fin-guiding slots of the body tube and the fin roots mount in the fin-mounting seats of the arcuate brackets. In addition, forward ends of the brackets define flanges that radially project over the front end of the engine tube, to position the engine tube within the engine tube assembly.

The fin-mounting seats are formed on and extend longitudinally, i.e. axially, along the exterior of the engine tube assembly. Each fin-mounting seat is elongated and generally U shaped for mountingly seating the entire root of a rocket fin. Each fin can therefore be secured, typically with an adhesive such as a plastic model cement, generally along the entire axial extent of the fin root to one cooperatively elongate fin-mounting seat.

A model rocket assembled according to one practice of the invention has a cylindrical engine tube assembly in which the fin receiver includes at least two arcuate brackets assembled side-by-side over an engine tube. The assembly fits within the rearward end of the body tube. Respective fin roots pass through fin-guiding slots in the body tube and mount in respective fin-mounting seats of the assembled brackets. An engine hook mounted on the engine tube holds in place the solid propellant engine when it is installed in the engine tube. The assembled rocket can also have, as known in the art, a nose cone that caps one end of the body tube, and a parachute tethered to the assembled rocket and captured within the body tube and nose cone.

A preferred practice has as many arcuate brackets in the fin receiver as there are fins on the rocket, and the seat for mounting each fin root is formed at the juncture between two side-by-side brackets.

Because of the extensive surface-area contact between the fin roots and the fin-mounting seats, a variety of generally available plastic model cements can be used to secure the fins to the seats in practice of the invention. Thus, a kit according to the invention can be safely put in the hands of a youngster, for whom it is desired to use only common plastic model cement. The new structure which the invention provides thus avoids the prior art requirement for the rather sophisticated, harder to use, and perhaps dangerous adhesives.

In further consideration of the needs of novice rocket builders, a kit according to one practice of the invention has arcuate brackets that are preformed to assemble over the engine tube with only rudimentary alignment. Essentially, the brackets cooperate with the engine tube to provide only one correct arrangement for their proper assembly, and this is one which is easy to obtain. Therefore, the assembly is both easy and nearly error-free. In short, the brackets easily engage together to form a cylindrical assemblage, and are cemented together at their adjoining edges. The assembled brackets form the fin receiver and house the engine tube. The forward flanges of the assembled brackets extend radially over the forward end of the engine tube to position the engine tube within the joined brackets without requiring further adhesive.

In one preferred embodiment, the brackets are cemented to the engine tube and to each other. Flanges at the forward end of the brackets locate the brackets on the engine tube.

Because there is only minimal alignment during assembly of the cooperating parts to form the fin-mounting seats, the engine tube assembly can be mounted within the body tube while the cement applied to the joined bracket edges is still unset. Furthermore, application of such cement can be made over-abundantly, i.e., cement can be sloppily applied to the bracket edges and can even fill the fin-mounting seats, as long as the kit is assembled before the cement sets, with the fin roots being mounted through the body tube slots into the fin-mounting seats and the unset cement. This arrangement secures the fins and the engine tube assembly to the body tube without any measuring or difficult alignment or exacting assembly steps. Also, the entire assembly can be done at once, without interruption to allow adhesive to set. Further, there are no parts like the prior centering rings that require alignment and careful spacing.

In one preferred practice of the invention, additional securing of the engine tube assembly to the body tube is obtained by mounting launch lugs through lug-guiding slots in the body tube and into lug-mounting receivers in the engine tube assembly. This further assembly involves aligning the lug-mounting receivers of an engine tube assembly with the lug-guiding slots of the body tube. However, the location of the launch lugs is predetermined, and the lugs are therefore self-aligning inter r& and thus easy to install.

The axial location and the centering of the engine tube assembly within the body tube is achieved by close cooperation of the fins with the fin-guiding body tube slots and by the subsequent mounting of the fin roots in the fin-mounting seats of the brackets. Additionally, the mounting of the launch lugs through their assigned body tube lug-guiding slots into the lug-mounting receivers of the engine tube assembly can augment the positioning of the kit parts.

A shock cord is coupled between a shock cord holder mounted in the body tube and the parachute, with the bulk of the cord stuffed into the front portion of body tube. In one illustrative instance, the shock cord holder is mounted to the tube body with a keeper plate that slides behind ribs of the holder on the inside of the body. The fully assembled rocket is deployed in a conventional manner.

The invention can, in an alternative practice, employ a one-piece fin receiver that provides structural features and functions corresponding to those described above for the fin receiver assembled from separate brackets.

BRIEF DESCRIPTION OF THE DRAWINGS

For a fuller understanding of the nature and objects of the invention, reference should be made to the following detailed description and the accompanying drawings in which:

FIG. 3 is a perspective view, partly broken away, of an assembled engine tube assembly according to the practice of the invention shown in FIG. 2;

FIG. 3A is a fragmentary detail view showing the front flange of the fin receiver in positioning abutment with the front of the engine tube;

FIG. 4 illustrates the assembly of the nose cone, tether and parachute parts of the rocket with the rocket body tube;

FIG. 4A is a fragmentary detail view showing the assembly of a keeper plate with locking tabs on the cord holder to secure the holder to the body tube;

DESCRIPTION OF ILLUSTRATED EMBODIMENT

Figure 1:
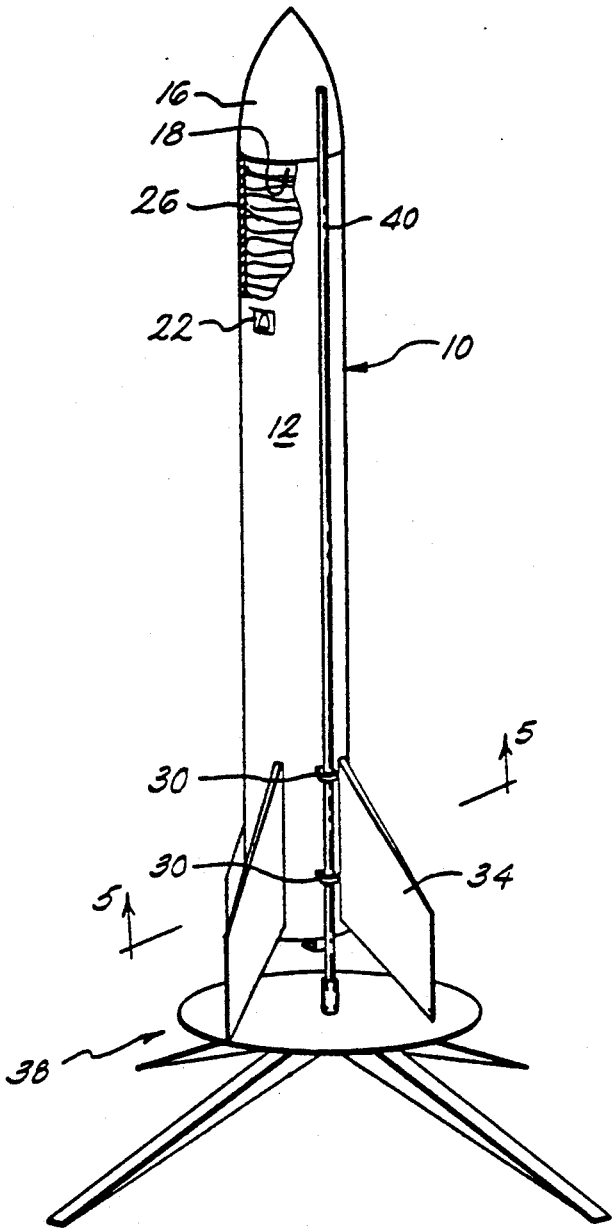
FIG. 1 is a side view of one practice of the invention with a model rocket, assembled from a kit, on a launch pad.
Figure 2:
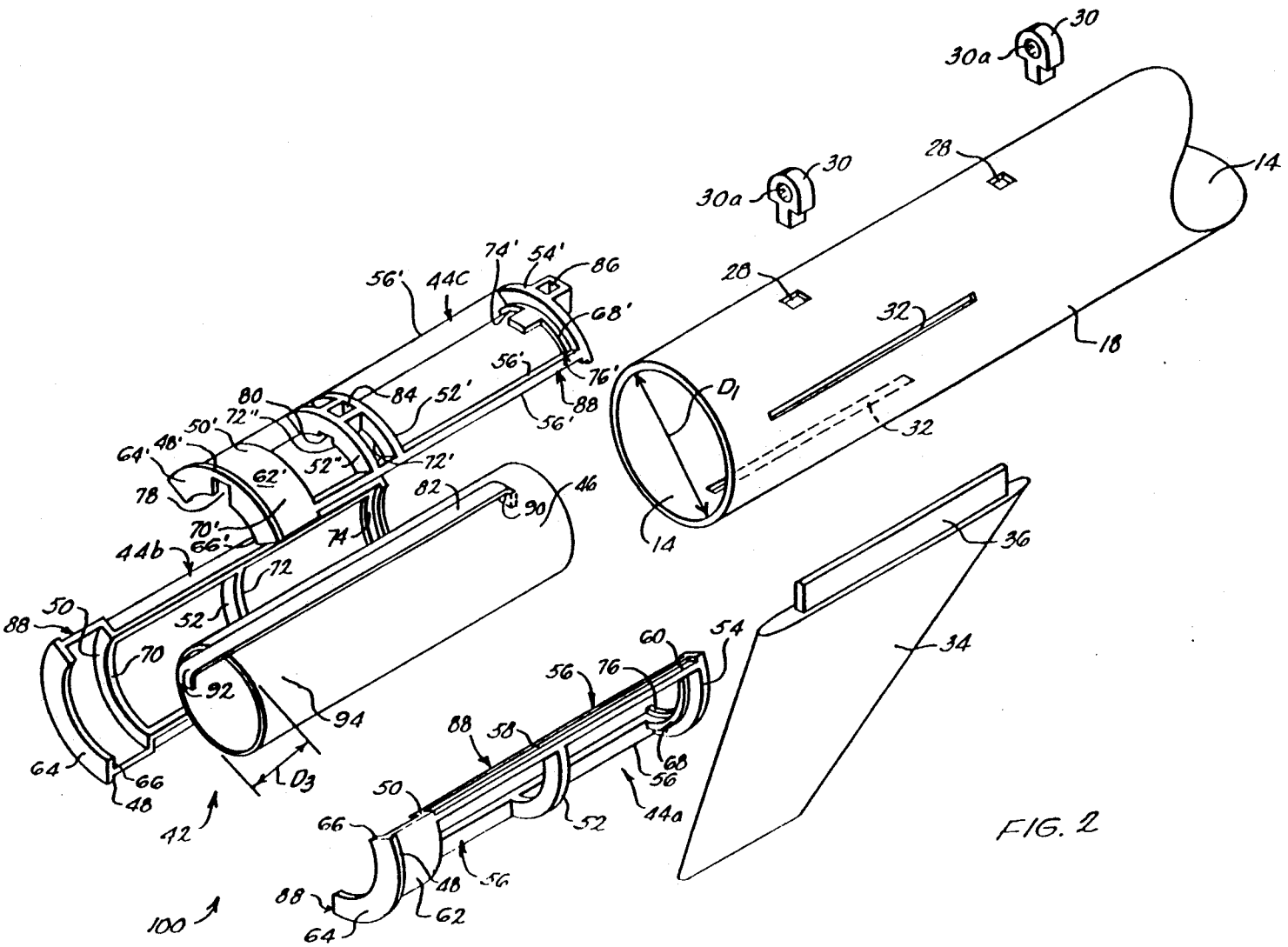
FIG. 2 is a fragmentary exploded view showing the assembly of a model rocket kit according to one practice of the invention.
Figure 5:
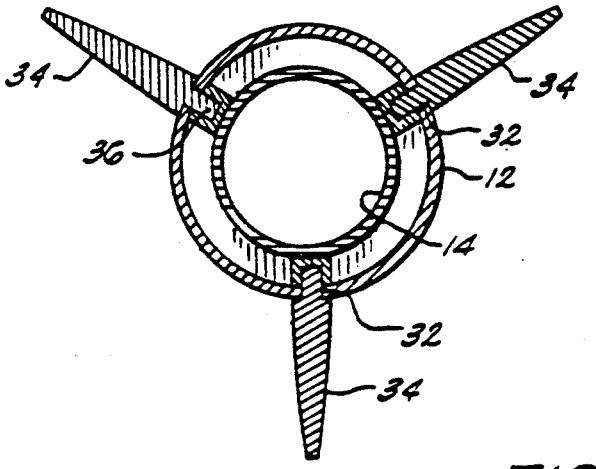
FIG. 5 is a transverse sectional view along line 5—5 of FIG. 1.
Figure 6:
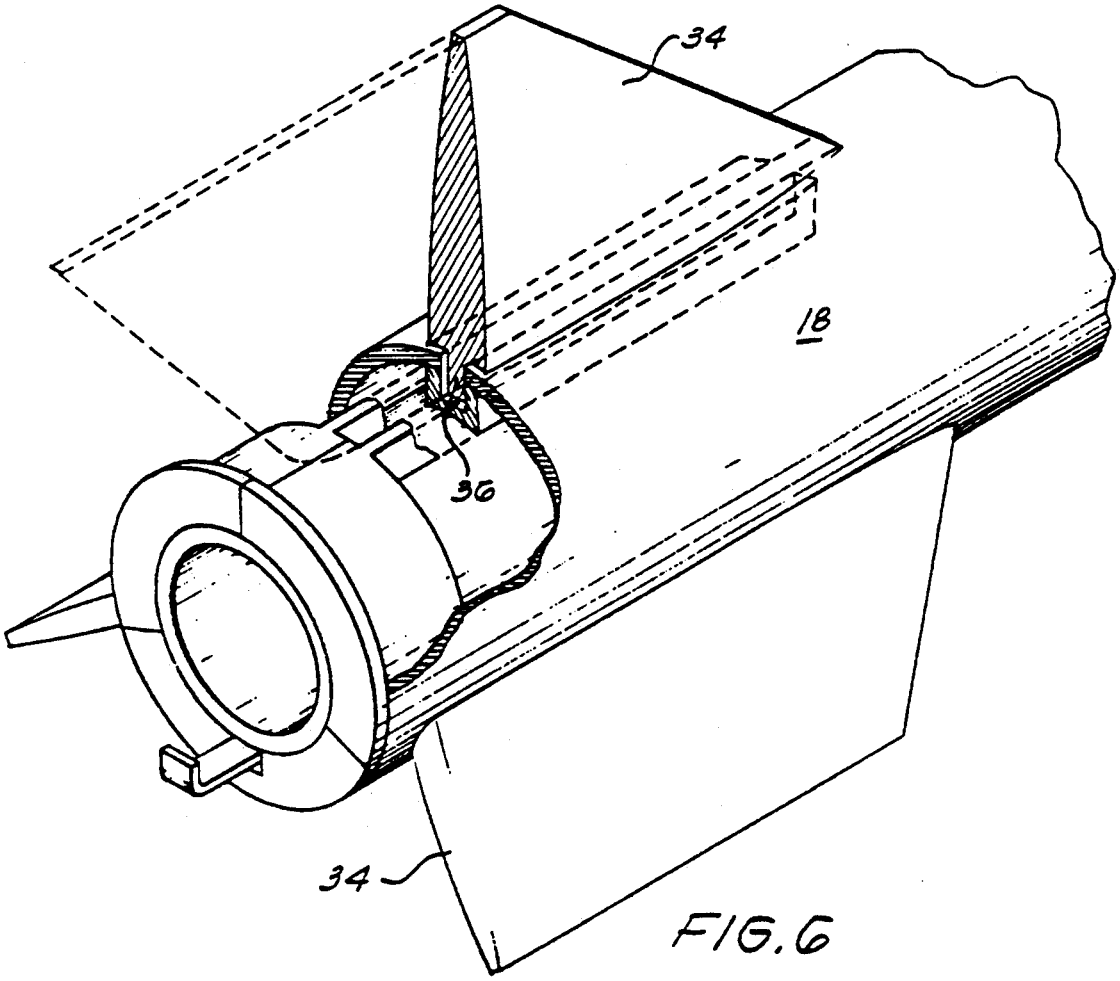
FIG. 6 is a partial perspective view, partly broken away, of the fins mounted on the rocket.

One practice of the invention is shown in FIGS. 1 and 4, wherein a model rocket 10 has a rigid body tube 12, having an inner bore 14 of diameter $D_1$ (FIG. 2). The body tube mounts a nose cone 19 at its axially forward end. The nose cone has a recessed terminating collar section 18 that matingly seats within the inner bore 14 of the body tube 12.

An aperture 20 in the body tube receives a shock cord holder 22 that secures one end of a shock cord 24 to the body tube. As shown in FIG. 4A, the illustrated holder 22 projects locking tabs 23 into the inside of the tube, and a keeper plate 21 slidingly engage the tabs to secure the holder to the body tube. The other end of the shock cord secures a parachute 26, all of which can be stowed within the forward end of the body tube 12. The body tube 12 also has lug-guidance apertures 28 for the mounting receipt of launch lugs 30.

Also aperturing the body tube 12 are fin-guiding slots 32 that receive and guide the fins 34 of the rocket 10. As illustrated, three fins 34 mount to the rocket 10 at equal circumferentially spaced slots 32. Each fin inner end has a root 36 radially extending inwardly into the body tube 12 through the slot 32.

FIG. 1 shows the assembled rocket ready for launch from a launch pad 38. The rocket stands by its fins on a platform of the launch pad, and the lugs 30 are slideably seated on an upright launch-guiding rod 40 on the platform.

The illustrated practice of the invention has, as shown in FIG. 2, an engine tube assembly 42 formed by joining three circumferentially mating arcuate brackets 44*1-c* over an engine tube 46. The assembled brackets form a fin receiver 43. The illustrated brackets 44*a* and 44*b* are identical and corresponding parts thereof are designated with identical reference numerals. The remaining bracket 44*c* has some structural differences, and corresponding parts thereof bear the same reference numeral with added prime or double-prime notation. The engine tube 46 has an outer diameter $D_3$. The assembled brackets form the fin receiver with a cylindrical skeleton having a predominant outer diameter $D_2$ closely equal to but less than the body tube inner bore diameter $D_1$. End flanges 48, 48 on the brackets define an outer diameter slightly greater than the body tube inner diameter $D_1$. The assembled brackets capture and radially center the engine tube assembly within the body tube.

The brackets 44*a-b* each include rearward, central and forward arcuate transverse (i.e., circumferentially extending) segments 50, 52, 54, respectively, joined by axial webs (i.e., longitudinal beams) 56. Each web 66 defines a radially outwardly extending flange portion 58 adjacent a radially recessed area 60 running longitudinally along the web from an inner radial wall of rearward segment 50 past central segment 52 to an inner radial wall of forward segment 54. A raised boss 61 interrupts each recessed area 60 at a location selected along the web 56 and offset from the axial middle. Segment 50 is coupled by a land 62 to a rear end plate 64. Each end plate 64 includes the aforesaid outer radial flange 48 and an inner radial flange 66.

The bracket 44*c* includes rearward and forward arcuate transverse segments 50' and 54', respectively, and arcuate dual-span segment 52'-52", joined by webs (i.e., longitudinal beams) 56'. Like webs 56 of brackets 44*a* and 44*b*, each web 56' defines a like radially outer flange portion 58 which includes a like radially recessed area 60. The recessed area 60 of web 56' runs longitudinally along the web from the inside of rearward segment 50' past central segment 52'-52" to the inside of forward segment 54'. Segment 50' is coupled by a land 62' to end plate 64'. End plate 64' defines the aforesaid outer radial flange 48' and an inner radial flange 66'.

The brackets 44*a-c*, as assembled, snugly receive and hold the engine tube 46. A respective rim 68, 68, 68' is formed on the inside of each forward segment 54, 54' to assure such close fit. In particular, respective inner faces 70, 72, 74 of the segments 50 and 52 and rim 68, and 70', 72', 74' of segments 50' and 52' and rim 68', form a common inner diameter slightly greater than the engine tube outer diameter $D_3$.

The lands 62, 62' and, the segments 52, to 52'-52" and 54, 54' extend radially outwardly to define the outer diameter $D_2$ of the assembled brackets 44*a-c* (i.e., of engine tube assembly 42). The flanges 66, 66 and 66' of the rear end plates 64, 64 and 64' extend axially inward to snugly seat the engine tube 46, as shown at the left end of FIG. 3.

As shown in FIG. 3A, the inner rims 76, 76 and 76' of the forward segments 54, 54 and 54' extend radially inward to a capture diameter smaller than the engine tube diameter $D_3$ so as to fix the forward position of the engine tube. This capture diameter is greater than the diameter of any engine intended to be loaded into the engine tube, so as to facilitate such installation.

Turning again to bracket 44*c*, and with reference to FIGS. 2 and 3, the end plate 64' and the central segment 52'-52" each is slotted to define respective radially interior recesses 78, 80 for accommodation of an engine hook 82. Also, the central segment 52'-52" of the bracket 44*c* is radially apertured to define a first launch lug receiver 84. The axially forward edge of the forward segment 54' defines a second launch lug receiver 86.

To assemble the rocket 10, two of the brackets 44*a-c* are cemented together, along their respectively mating longitudinal edges 88, over the engine tube 46. The third bracket is then cemented in place, also along respectively mating longitudinal edges 88, over the engine tube 46, with one end of the engine hook 82 mounted in a slot 90 of the engine tube 46 and the other end 92 of the hook projecting radially inward to over-hang the rear end 94 of the engine tube. The three assembled brackets form the fin receiver 43, and the brackets assembled over the engine tube and hook form the engine tube assembly 42.

Each pair of adjacent brackets forms a respective longitudinally extending fin-mounting slot-shaped seat 96 between themselves. Each seat 96 is configured for intimate and close-fitting receipt of an assigned fin root 36. The bosses 61, 61 of the adjacent brackets interrupt the slotted-like seat 96. This interrupting barrier aligns with a slot 36*a* in a fin root 36, to ensure that the fin is mounted therein with the proper orientation.

The engine tube assembly 42 inserts into the inner bore 14 of the body tube 12, with the fin-guiding slots 32 of the body tube aligned with the fin-mounting seats 96 of the engine tube assembly and with the launch lug guide-slots 28 of the body tube aligned with the launch lug receivers 84, 86 of the engine tube assembly.

Each fin root 36 inserts through a respective body tube slot 32 and is cemented in mating relationship with an awaiting respective fin-mounting seat 96. The launch lugs 30 are inserted through a respective slot and are cemented into a respective receiver 84, 86.

A solid propellant charge (i.e, the engine) is loaded into the assembled model rocket 10 by insertion of the charge past a deflected hook end 92 and into the interior 98 of the engine tube;-the hook end grasps over the end of the engine to hold it in place.

The loaded rocket is placed on launch pad 38 with the respective bores 30*a* of launch lugs 30 mated over launch guiding rod 40. The first stage is ignited and the rocket surges into flight. After the third stage explodes, the nose cone 16 separates from the body tube 12, the parachute 26 deploys, and the rocket 10 falls back to the earth.

It will be appreciated that the rocket structure of the present invention enjoys many benefits over the prior art, such as: being easy to assemble (no special cutting or alignment issues); having simplified cementing operation (no waiting for cement to cure on aligned parts before inserting the engine tube assembly into the body tube and attaching the fins); enabling rapid assembly, even with unset cement; and having a large surface-area capture of the fin roots in the fin-mounting seats, which allows use of weaker and safer plastic cement, with which youngsters can be trusted, versus stronger glues such as epoxies and the like.

It will thus be seen that the objects set forth above, among those made apparent from the preceding description, are efficiently attained. It will be understood that changes may be made in the above constructions and in the foregoing sequences of operation without departing from the scope of the invention. As previously noted, one such change is to employ a one-piece fin receiver, in lieu of one that is assembled from multiple bracket pieces. It is accordingly intended that all matter contained in the above description or shown in the accompanying drawings be interpreted as illustrative rather than limiting.

Accordingly, what is claimed as new and secured by Letters Patent is:

1. Apparatus in kit form for the assembly of a model rocket having a body tube, fins, and propellant mount, wherein the body tube has axially spaced ends and axially extending apertured slots defined between said ends, and wherein each fin has a root portion at a radially inner-most end for mountingly extending through the body tube slots for mounting engagement with the propellant mount, and wherein the propellant mount mounts within the body tube, the improvement comprising a plurality of mounting brackets arranged for mating assembly with one another for forming said propellant mount, each said mounting bracket having radially-extending mounting means for engaging and positioning a fin root, said radially-extending mounting means of the assembled mounting brackets defining respective axially extending socket means for mounting the root of respective fins, said socket means extending substantially at least tat length defined by said fin root, said assembled fins and mounting brackets forming said socket means in fixed rotational alignment and forming each of said socket means with axially spaced ends thereof arranged for seating axial ends of said fin roots.

2. An apparatus in kit form according to claim 1, the further improvement in which said body tube has a cylindrical inner wall, and in which said mounting brackets are arranged for side by side assembly with one another circumferentially within said cylindrical inner wall of said body tube.

3. An apparatus in kit form according to claim 2, the further improvement in which said mounting brackets comprise mounting means defining each said socket means with axially forward and rearward walls and with circumferentially spaced side walls axially extending between said end walls, and for mountingly seating therein one fin root.

4. An apparatus in kit form according to claim 3, the further improvement in which each said mounting bracket comprises radially-extending mounting means that forms one said side wall of at least one socket means and that forms a part of the forward and rearward end walls of that socket means.

5. An apparatus in kit form according to claim 4, the further improvement in which each said mounting bracket has circumferentially spaced sides and has said radially-extending mounting means arranged for forming two said socket means, one on each circumferentially spaced side thereof.

6. An apparatus in kit form according to claim 4 in which said radially-extending mounting means of each said mounting bracket are arranged for forming substantially a circumferentially disposed half of one socket means, the further improvement in which said mounting brackets are arranged for forming with said radially-extending mounting means thereof substantially half of each socket means that the mounting bracket defines.

7. An apparatus in kit form according to claim 2, the further improvement in which said assembled mounting brackets further comprise radially inner-most wall portions for defining a cylindrical passage for receiving a rocket engine propellant.

8. An apparatus in kit form according to claim 2, the further improvement in which said assembled mounting brackets have means defining first and second axially spaced anchorages for mountingly receiving and seating first and second respective radially-extending projections, extending radially inward from the body tube.

9. An apparatus in kit form according to claim 1, the further improvement wherein said assembled mounting brackets define an engine tube receiver for receipt of an engine tube.

10. An apparatus in kit form according to claim 1 in which said mounting brackets are arranged for side-by-side assembly with one another circumferentially within the cylindrical inner wall of said body tube.

11. Apparatus in kit form for the assembly of a model rocket having a body tube, fins, and propellant mount, wherein the body tube has axially spaced ends and axially extending apertured slots defined between said ends, and wherein each fin has a root portion at a radially inner-most end for mountingly extending through the body tube slots for mounting engagement with the propellant mount, the improvement comprising tubular engine tube means, tubular fin receiver means for telescopically housing therein said engine tube means for forming said propellant mount, said receiver means having an outer surface recessed with radially-extending mounting means for engaging and positioning a fin root, and said radially-extending mounting means defining respective axially extending socket means for mounting and bonding the root of respective fins, said socket means extending substantially at least that length defined by said fin root, said assembled fins and receiver means forming said socket means in fixed rotational alignment and forming each said socket means with axially spaced ends thereof arranged for seating axial ends of said fin roots.

* * * * *